US006340220B1

(12) United States Patent
Gaylor et al.

(10) Patent No.: US 6,340,220 B1
(45) **Date of Patent: *Jan. 22, 2002**

(54) TRANSFERRING SPITTOON SYSTEM FOR WASTE INKJET INK

(75) Inventors: Dean A. Gaylor; Michael S. Millman, both of Vancouver, WA (US); John A. Barinaga, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/494,845

(22) Filed: Jan. 31, 2000

(51) Int. Cl.[7] ..... B41J 2/165
(52) U.S. Cl. ..... 347/35
(58) Field of Search ..... 347/35, 33, 36, 347/38

(56) References Cited

U.S. PATENT DOCUMENTS

| | | | | |
|---|---|---|---|---|
| 4,231,046 A | 10/1980 | Aiba | ..... | 347/29 |
| 5,081,472 A | 1/1992 | Fisher | ..... | 347/29 |
| 5,617,124 A | 4/1997 | Taylor et al. | ..... | 347/35 |
| 5,815,176 A | 9/1998 | Rotering | ..... | 347/33 |
| 6,082,848 A | 7/2000 | Taylor | ..... | 347/35 |
| 6,213,583 B1 * | 4/2001 | Therien | ..... | 347/36 |
| 6,247,783 B1 * | 6/2001 | Shibata et al. | ..... | 347/35 |

* cited by examiner

*Primary Examiner*—N. Le
*Assistant Examiner*—Shih-wen Hsieh
(74) *Attorney, Agent, or Firm*—Flory L. Martin

(57) ABSTRACT

A transferring spittoon system is provided for an inkjet printing mechanism to handle waste inkjet ink that has been spit from an inkjet printhead during a nozzle clearing, purging or "spitting" routine. A rotating spit wheel receives ink residue spit from the printhead. A scraper removes the residue from the spit wheel and directs the residue into a temporary storage container. A transfer mechanism transports the ink residue from the temporary storage container to a permanent storage container. A second scraper may be used to remove the residue from the transfer mechanism and direct the residue into the permanent storage container. The transfer mechanism may be a rotating auger, a conveyor belt, or a turntable. A method of purging ink residue from an inkjet printhead, along with an inkjet printing mechanism having such a transferring spittoon system, are also provided.

20 Claims, 8 Drawing Sheets

TRANSFERRING SPITTOON SYSTEM FOR WASTE INKJET INK

FIELD OF THE INVENTION

The present invention relates generally to inkjet printing mechanisms, and more particularly to a storage and spittoon system for handling waste inkjet ink that has been spit from an inkjet printhead during a nozzle clearing, purging or "spitting" routine.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. Narrower printheads may lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media. However, the combination of small nozzles and quick-drying ink leaves the printheads susceptible to clogging, not only from dried ink or minute dust particles, such as paper fibers, but also from the solids within the new inks themselves.

When spitting these new pigment-based inks onto the flat bottom of a conventional spittoon, over a period of time the rapidly solidifying waste ink grew into a stalagmite of ink residue. Eventually, in prototype units, the ink residue stalagmite grew to contact the printhead, which then either could interfere with printhead movement, print quality, or contribute to clogging the nozzles. Indeed, these stalagmites even formed ink deposits along the sides of the entranceway of prototype narrow spittoons, and eventually grew to meet one another and totally clog the entrance to the spittoon. To avoid this phenomenon, conventional spittoons had to be wide enough to handle these high solid content inks. This extra width increased the overall printer width, which then defeated the narrowing advantages realized by using an off-axis printhead system.

A ferris wheel spittoon system was disclosed in U.S. Pat. No. 5,617,124, currently assigned to the present assignee, the Hewlett-Packard Company. This system proposed an elastomeric ferris wheel as a spit surface. Ink residue was removed from the wheel with a rigid plastic scraper that was oriented along a radial of the wheel so the scraper edge approached the spitting surface at a substantially perpendicular angle. The scraper was located a short distance away from the surface of the wheel, so it unfortunately could not completely clean the spitting surface. Furthermore, by locating the scraper a distance from the spit surface, the scraper was ineffective in removing any liquid ink residue from the wheel. This earlier ferris wheel spittoon system failed to provide for adequate storage of the ink residue after removal from the ferris wheel during the desired lifespan of a printer.

One remedy for this ink residue storage problem was first commercially available in the Hewlett-Packard Company's DeskJet® 2000C Professional Series color inkjet printer, which scraped the black ink residue from the surface of a ferris wheel type spit wheel and collected the residue in a storage bucket. A ratchet mechanism was used to rotate the spit wheel past a scraper which was spring-biased against the wheel and located to direct the residue into the storage bucket. In this system, the capacity of the storage bucket was approximately 55 cc (cubic centimeters) of residue; however, given the consistency of the pigment-based black ink as it dried, which is similar to tar, the waste ink did not pack efficiently into the available volume of the storage bucket. While this system works well for the lifetime of typical desktop printers, for heavy volume printers, such as those which are networked or used as short run press printers, the storage bucket capacity was inadequate. Indeed, as future printers are designed, there is a tendency to move toward using pigment-based color inks, as well as pigment-based black inks, so the ability to store waste ink residue will increase. Various design constraints on the printer, such as the footprint, means that merely adding a larger bucket is not feasible.

Thus, it would be desirable to have a spittoon system which provides for ink residue storage during the lifespan of the inkjet printing unit without increasing the overall size or "footprint" of the unit.

SUMMARY OF THE INVENTION

According to one aspect of the present invention, a transferring spittoon system is provided for receiving ink residue spit from an inkjet printhead in an inkjet printing mechanism. The spittoon system includes a temporary storage container that receives ink residue which has been spit from the inkjet printhead. The temporary storage container has an exit opening. The spittoon system also has a permanent storage container, and a transfer mechanism. The transfer mechanism receives the ink residue from the temporary storage container exit opening and transfers the ink residue to the permanent storage container.

According to another aspect of the present invention, a method of purging ink residue from an inkjet printhead in an inkjet printing mechanism is provided. This method includes the step of providing a temporary storage container, a permanent storage container and a transfer mechanism. In a collecting step, ink residue spit from the printhead is collected in the temporary storage container. The method also includes the step of transferring the collected ink residue from temporary storage container to the permanent storage container using the transfer mechanism. Finally, in a storing step, the ink residue is stored in the permanent storage container.

According to a further aspect of the present invention, an inkjet printing mechanism may be provided with a transferring spittoon system for handling waste inkjet ink as described above.

An overall goal of the present invention is to provide an inkjet printing mechanism which prints sharp vivid images over the life of the printhead and the printing mechanism.

Still another goal of the present invention is to provide a transferring spittoon system that efficiently removes the waste ink residue from a spitting surface and then moves this residue to a location remote from the spit wheel for storage over the expected lifespan of an inkjet printing mechanism.

Another goal of the present invention is to provide a long-life spittoon system and method for receiving ink spit from printheads in an inkjet printing mechanism to provide consumers with a reliable, robust inkjet printing unit.

BRIEF DESCRIPTION OF THE DRAWINGS

FIGS. 4 and 5 are perspective views of one form of an indexing mechanism for rotating the spit wheel of FIGS. 2 and 3, with:

FIG. 4 showing a presetting motion; and

FIG. 5 showing the indexing motion.

FIGS. 6 and 7 are schematic side elevational views of one form of an indexing mechanism for rotating the auger transfer mechanism of FIG. 3, with:

FIG. 6 showing a presetting motion; and

FIG. 7 showing the indexing motion.

DETAILED DESCRIPTION OF THE PREFERRED EMBODIMENTS

Figure 1:
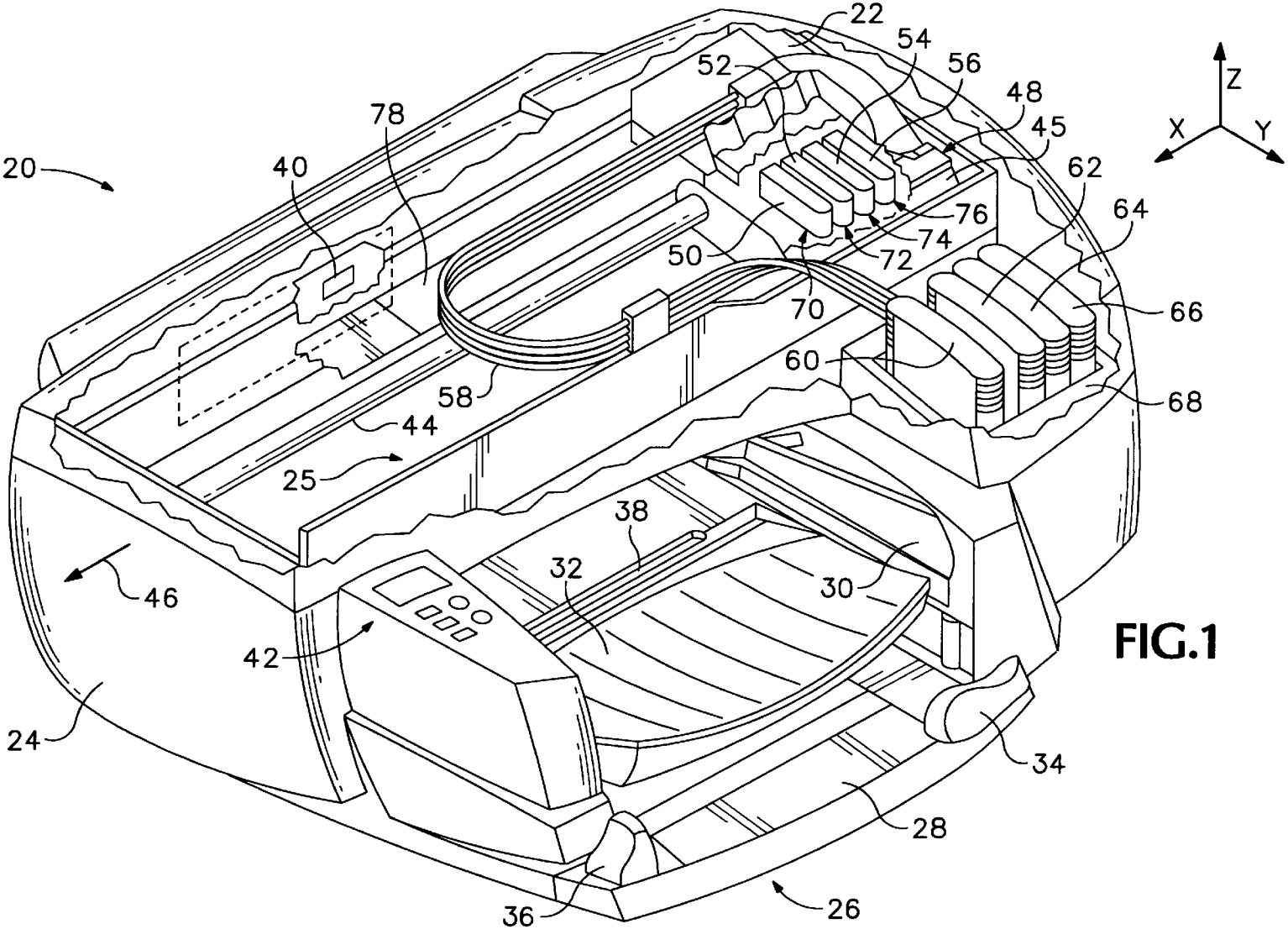
FIG. 1 is a perspective view of one form of an inkjet printing mechanism, here, an inkjet printer, including a printhead service station having one form of a transferring spittoon system of the present invention for servicing inkjet printheads.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a DC (direct current) or stepper motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42, which may include a display screen, located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slidably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

Figure 2:
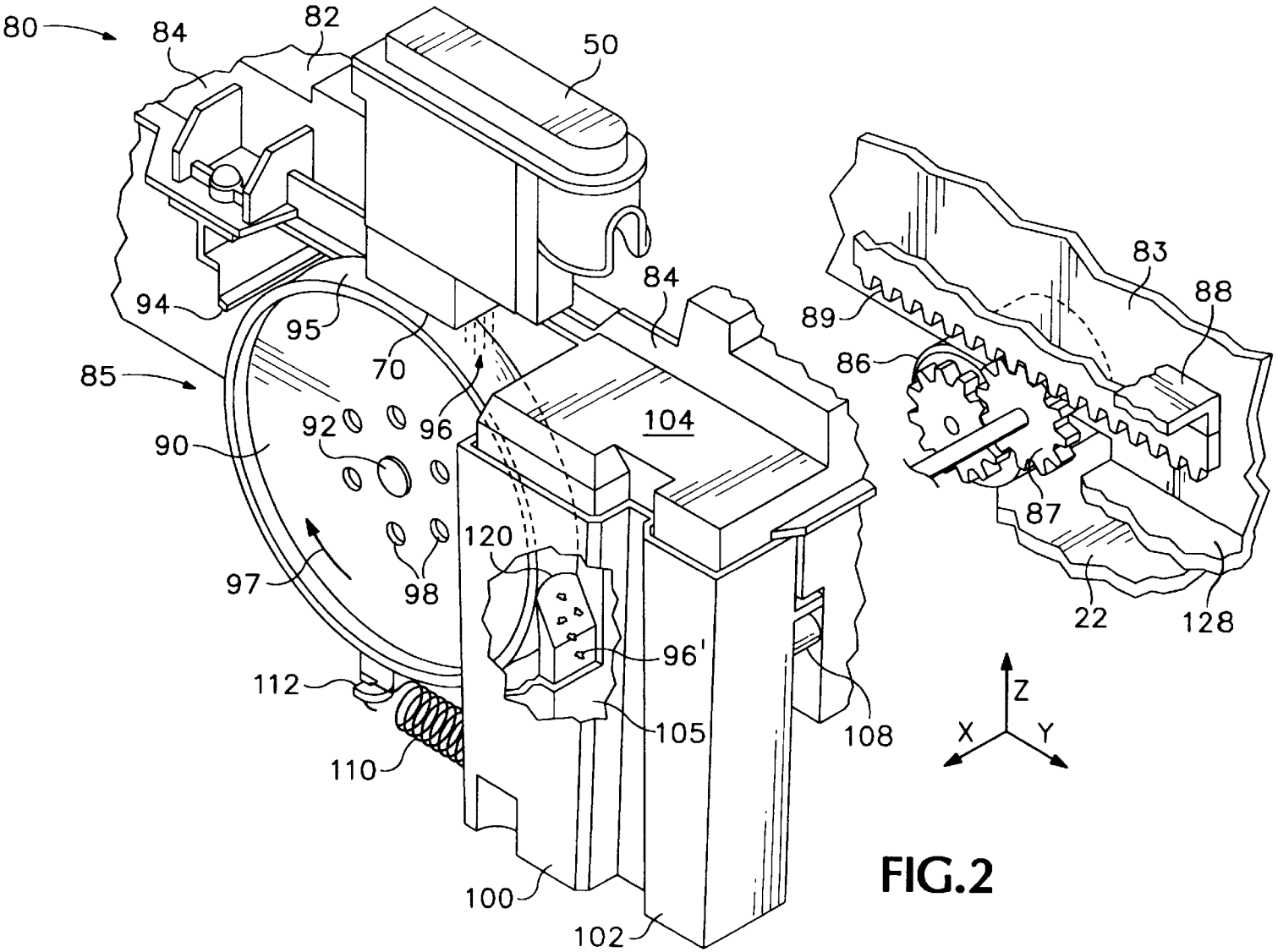
FIG. 2 is a perspective view of one form of a waste ink receiving portion of the service station of FIG. 1, including a spit wheel which receives ink residue spit from an inkjet printhead during a spitting routine, a scraper which removes the ink residue from the spit wheel and a temporary storage container or bucket which holds the scraped liquid and semi-solid ink residue prior to transfer to a permanent storage location

In the printzone 25, a media sheet receives ink from an inkjet cartridge, such as a black ink cartridge 50 and three monochrome color ink cartridges 52, 54 and 56, shown schematically in FIG. 2. The cartridges 50–56 are also often called "pens" by those in the art. The black ink pen 50 is illustrated herein as containing a pigment-based ink. While the illustrated color pens 52–56 each contain a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to from an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a series of ink-ejecting nozzles which may be manufactured in a variety of conventional ways well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

Transferring Spittoon System For Handling Waste Inkjet Ink

FIG. 2 illustrates one form of a service station 80 constructed in accordance with the present invention for servicing the black and color printheads 70–76. The service station 80 has a main frame 82 that is supported by the printer chassis 22 in the servicing region 48 within the printer casing 24. The service station frame 82 has an outboard sidewall 83 and an inboard sidewall 84, with "inboard" referring to the direction of the positive X axis toward the printzone 25 and "outboard referring to the opposite direction. The inboard sidewall 84 supports a portion of a transferring spittoon system 85, constructed in accordance with the present invention as a portion of the service station 80 for handling waste inkjet ink deposited in particular by the black printhead 70. The service station 80 may also include a conventional absorbent color ink spittoon (not shown) to receive ink spit from the color printheads 72–76, which in the illustrated embodiment dispense dye-based inks, as opposed to the black pen 50 which dispenses a pigment-based ink.

The service station 80 also includes a motor and drive gear assembly 86 which is supported by the outboard sidewall 83. The drive assembly 86 is coupled to drive a spindle gear 87, with only one gear and a portion of the drive shaft being shown in FIG. 2. The spindle gear 87 drives a pallet 88 back and forth in the positive and negative Y-axis directions through engagement with a rack gear 89 located along an undersurface of the pallet 88. The pallet 88 may support a variety of servicing mechanisms, such as printhead caps and wipers (not shown), which are not the subject of the present invention. The pallet 88 is coupled through a mechanism described further below to drive a spittoon wheel portion 90 of the transferring spittoon system 85. The motor assembly 86 rotates in response to control signals received from the printer controller 40 to drive the pallet 88.

The transferring spittoon system 85 includes a spindle or axle 92 which projects outwardly the service station frame sidewall 84 to rotationally support the spit wheel 90. A back-up wheel scraper 94 extends from the sidewall 84 to stop any gross accumulation of ink residue, which may have inadvertently adhered to the spit wheel, from passing under and possibly damaging the printhead 70. The spit wheel 90 has an outer rim 95, which preferably has a concave shaped cross section, to serve as a spit platform for receiving waste ink spit 96 from the black pen 50, which is the only printhead in the illustrated embodiment carrying a pigment-based ink. Preferably, the spit wheel 90 is mounted to receive the ink spit 96 along a descending portion thereof, as the wheel 90 is rotated in the direction of arrow 97. Locating the spit wheel rim 95 close to the printhead was found to significantly reduce the amount of airborne ink aerosol generated during a spitting routine, probably because more ink aerosol particles are captured through impact with the wheel before being carried away to undesirable locations by air currents inside the printer. The spit wheel 90 also defines a series of alignment holes, such as holes 98, which may be used during manufacture of the service station 80 to verify the spittoon wheel assembly and operation. Preferably, the spit wheel 90 is constructed of an ink-resistant, non-wetting material with dimensional stability, such as a glass fiber filled blend of polyphenylene oxide and polyethylene.

Another main component of the ink storage and spittoon system 85 is an ink residue storage container or bucket 100, which has a hollow body 102 that is preferably covered by a cover portion 104 extending outwardly from the service station frame sidewall 84. The spit wheel 90 rotates to transport ink 96 deposited thereon into the container 100 where the liquid components of the ink waste ink evaporate and the remaining solid ink residuals 96' are temporarily stored. Together, the container body 102 and cover portion 104 define a storage cavity or chamber 105 therein for receiving and holding this partially dried and liquid ink spit residue 96' prior to transfer to a permanent storage location. Optionally, an absorbent pad (not shown) may be placed within the storage chamber 105 to absorb ink residue liquid components while they evaporate. The container body 102 is preferably pivotally mounted to the frame sidewall 84 at a pivot post 108 which projects outwardly from wall 84. The container 100 pivots around post 108 and is resiliently pulled toward the spit wheel 90 by a biasing member, such as a tension spring 110 which joins a mounting tab portion 112 that extends outwardly from the sidewall 84. The service station frame 82, the spit wheel 90, and the storage bucket 100 may have other mating features to align the wheel and bucket to guide the solidifying residue 96' from the wheel rim 95 into the bucket.

Another main component of the transferring spittoon system 85 is a spit wheel scraper 120, which may be molded integrally with the bucket 100 beneath a chamber entrance portal that is defined by the container body 102 and/or the cover portion 104. It is apparent that the wheel scraper 120 may also be constructed as a separate member attached to the bucket, in the same manner as the spit wheel, wheel scraper, and bucket assembly of the spittoon system first sold in the Hewlett-Packard Company's DeskJet® 2000C Professional Series color inkjet printer, described in the Background section above. In this earlier printer, the scraper was constructed of an ink-resistant, non-wetting, low density polyethylene that was soft enough to have a compliant nature to allows the scraper to conform to the concave contour of the wheel rim. In the illustrated embodiment, the scraper 120 is constructed of the same hard plastic material as the bucket body 102.

Figure 3:
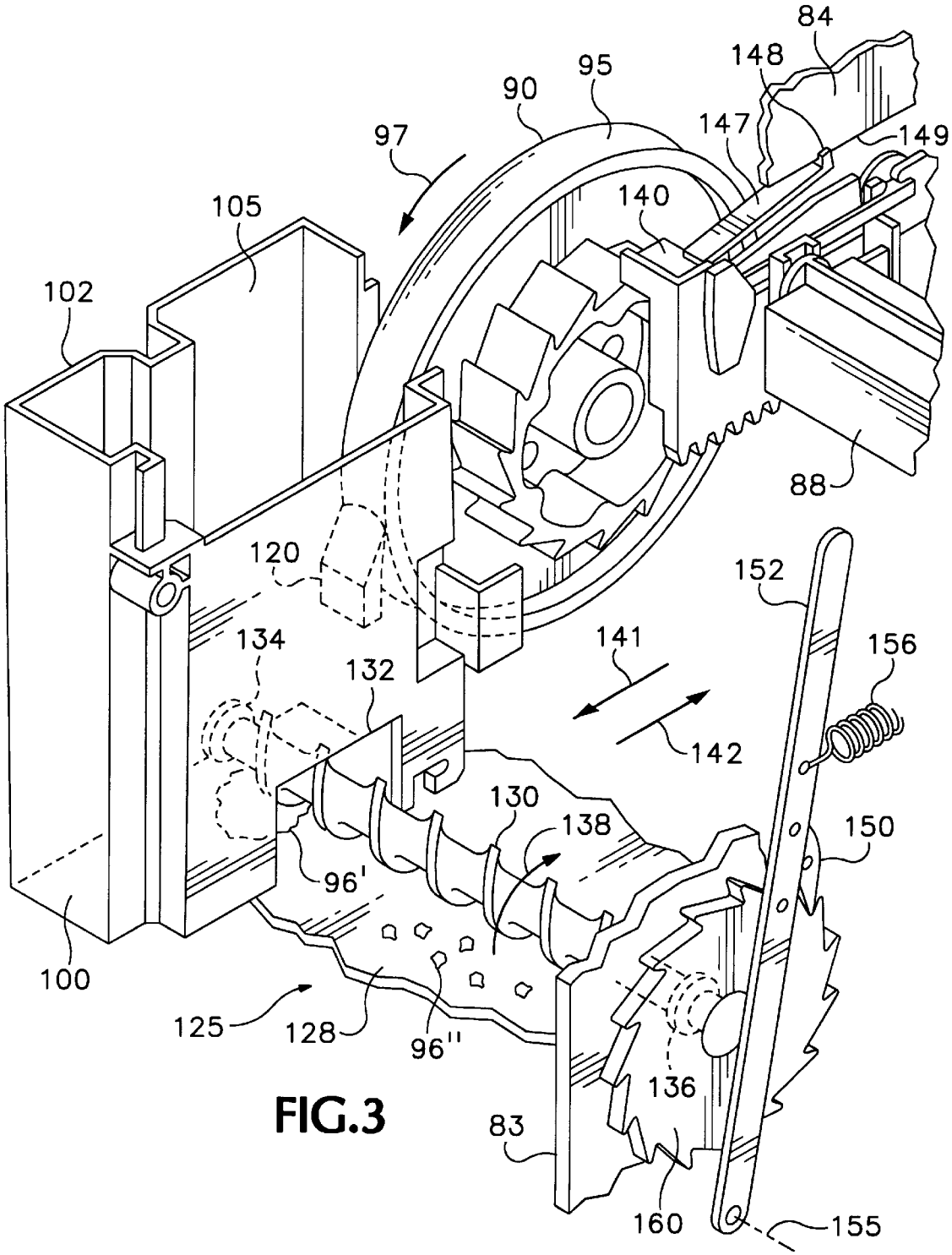
FIG. 3 is a perspective view of the service station of FIG. 1 including one form of a first embodiment of a transferring spittoon system having an auger transfer mechanism for moving ink residue from the temporary storage container to a permanent storage location.

FIG. 3 illustrates a first embodiment of a transferring mechanism, here illustrated as an indexed auger mechanism 125 constructed in accordance with the present invention for transferring ink residue 96' from the bottom of the storage bucket 100 to a permanent storage location within a permanent storage chamber 128 defined by a lower portion of the service station frame 82. The auger transfer mechanism 125 includes an auger or screw member 130 which extends through an opening 132 defined by the storage bucket body 102 to extend into the container cavity 105. The auger 130 may be pivotally mounted to the bucket body 102, for instance using a bearing or bushing member 134, with the opposite end of the auger 130 being pivotally mounted to the exterior of the frame outboard sidewall 83 using another bearing or bushing member 136. Ink residue removed from the spit wheel rim 95 by scraper 120 follows ink residue 96' to the bottom of the storage container 100. This ink residue 96' is removed by auger 130 as it rotates, for instance in the direction of arrow 138, to transport the residue 96' from the temporary storage bucket 100 to the permanent storage location chamber 128, where it is deposited as ink residue 96".

While rotation of the spit wheel 90 and the auger 130 may be accomplished through the incorporation of a separate motor or motors, it is preferable to use the service station motor and gear assembly 86 to provide the indexing motion to turn both wheel 90 and auger 130. One manner of accomplishing these rotations are shown in FIGS. 4–7, with FIGS. 4 and 5 illustrating rotation of the spit wheel 90, and FIGS. 6 and 7 illustrating the indexing rotation of the auger 130.

Figure 4:
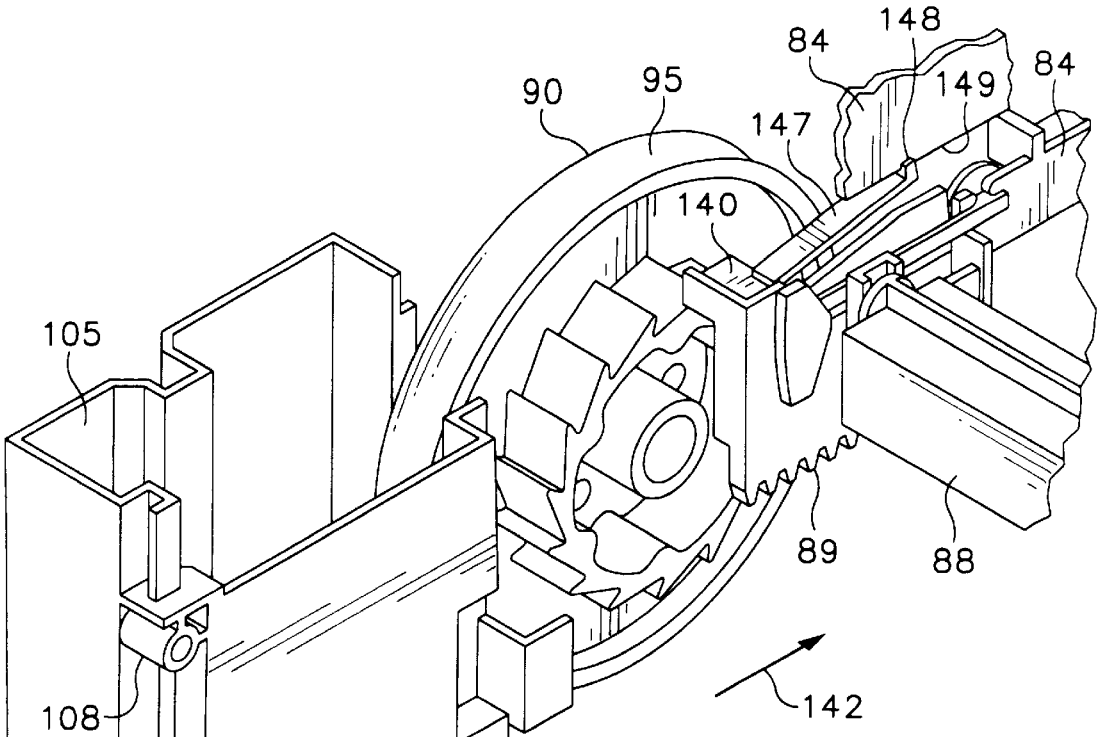
Figure 5:
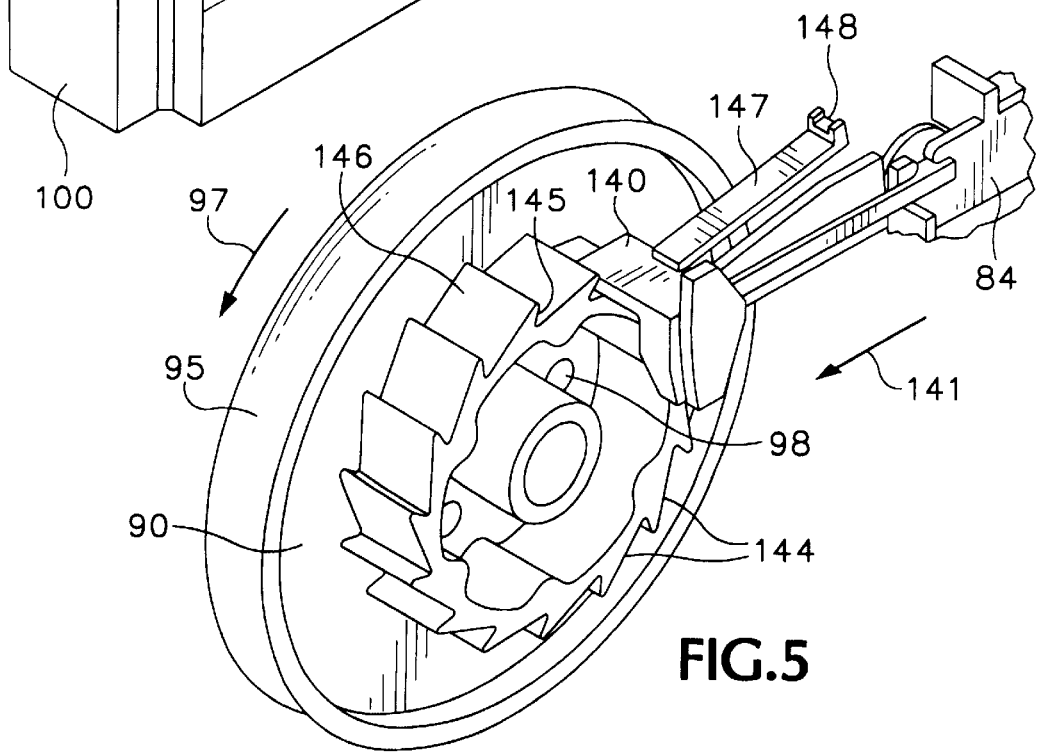

First referring to FIGS. 4 and 5, a ratcheting arm 140 is supported by the pallet 88 as shown in FIG. 4. Moving the pallet 88 in a forward direction, as indicated by arrow 141, advances the spit wheel 90 in the direction of arrow 97, while retreating the pallet 88 in a rearward direction, indicated by arrow 142, resets the ratchet mechanism. As better shown in FIG. 5 with the pallet 88 and rack gear 89 removed from the view for clarity, the interior surface of the spit wheel 90 contains a series of ratchet teeth 144. Each ratchet tooth 145 has an active tooth surface 145 and a passive surface 146. To push the ratchet arm 140 into positive contact with the ratchet teeth 144, the ratchet arm 140 includes a biasing member such as biasing arm 147 which has a notched distal end 148 that rides along a biasing surface 149 of a slot defined by the service station inboard sidewall 84.

FIG. 5 has the pallet 88 moving in the forward direction of arrow 141 so the ratchet arm 140 engages the active surface 145 of one of the ratchet teeth 144 to advance the spit wheel 90 in the direction of arrow 97. This forward motion 97 of the wheel 90 causes the scraper 120 (FIGS. 2 and 3) to remove the ink residue 96 from the rim 95, after which the residue falls into the storage bucket 100. In FIG. 4, to reset the ratchet arm for the next incremental rotation of the spit wheel 90, the pallet 88 is moved in the rearward direction of arrow 142. This rearward motion of pallet 88 allows the ratchet arm 140 to slide over the passive surface 146 of the next tooth in a clockwise direction in the view of FIG. 4, to ready the ratchet arm for another indexing stroke positioned against the active surface 145 of this next tooth. During this pre-setting stroke of FIG. 4, the spit wheel 90 remains stationary.

Figure 6:
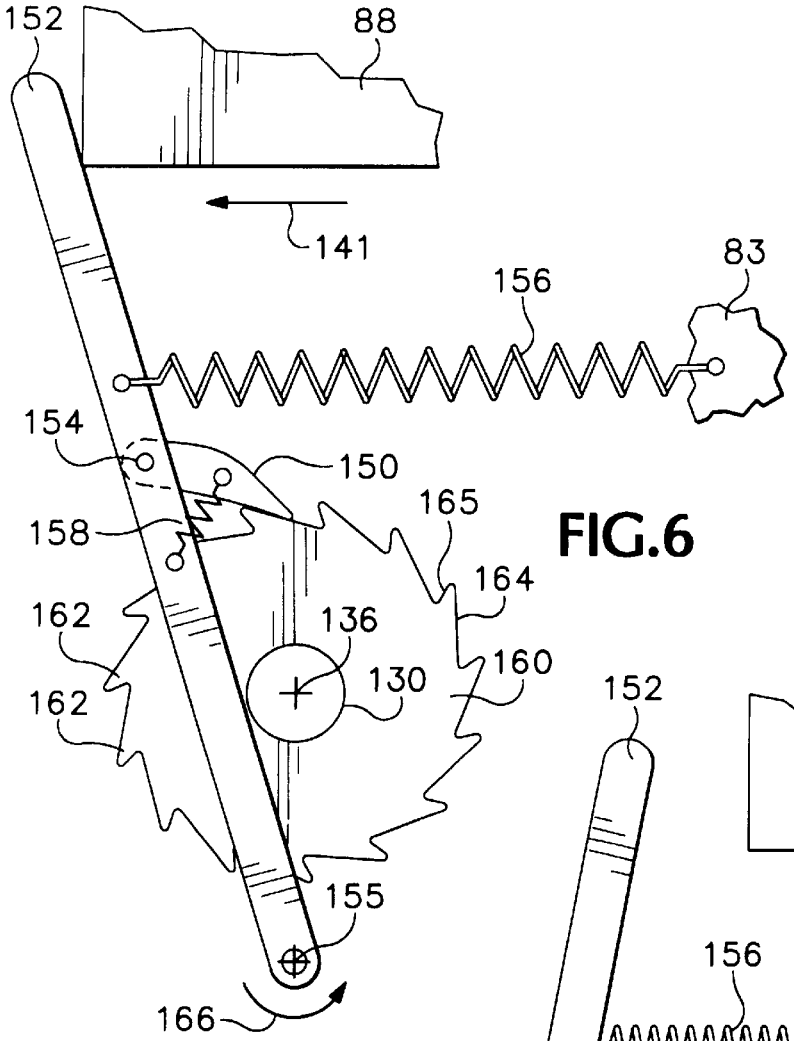
Figure 7:
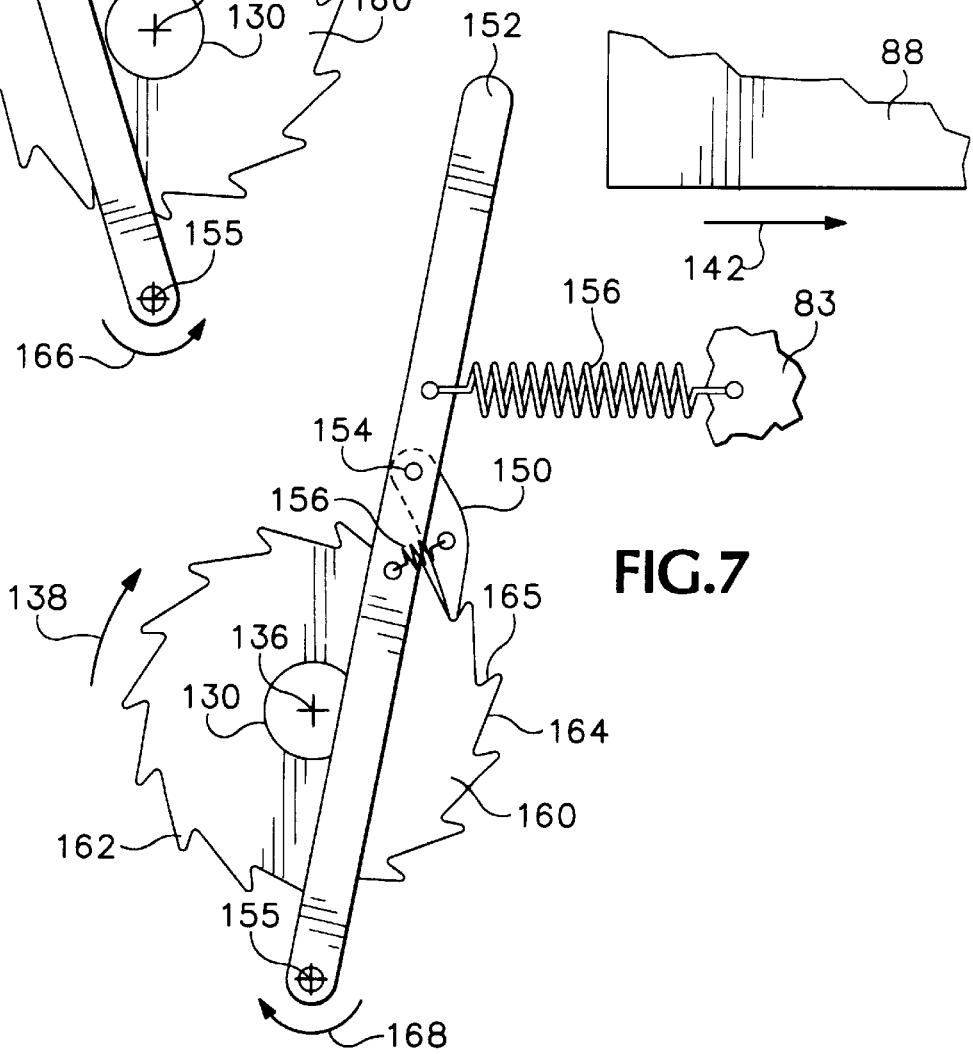

Turning to FIGS. 6 and 7, the indexing operation of the auger 130 is shown. An auger ratcheting arm 150 is pivotally coupled to an activation arm 152 at pivot post 154. The activation arm 152 is pivotally attached to a pivot post 155, extending outwardly from the service station frame sidewall 83 (see FIG. 3). An activation biasing member such as spring 156 couples the activation arm 152 to the service station frame sidewall 83, while a ratcheting arm biasing spring 158 pulls the ratchet arm 150 toward the activation arm 152. The auger 130 is coupled to be driven by a ratchet wheel 160 which has a plurality of ratchet teeth 162. Each tooth 162 has a passive surface 164 and an active surface 165.

FIG. 6 shows the presetting step, where the pallet 88 moves in the forward direction of arrow 141, and engages the activation arm 152. Here we see the activation arm 152 being rotated in the direction of arrow 166 around pivot 155, with this action serving to stretch the tension spring 156. During this presetting step, the ratchet arm 150 slides over the passive surface 164 of an engaged tooth, with this action serving to stretch the spring 158 as the ratchet arm 150 pivots in a counterclockwise direction around pivot post 154. Indeed, under the force of tension provided by spring 158, the ratchet arm 150 slides across the passive surface 164 of an engaged tooth and then drops down to engage the active surface 165 of this tooth.

As shown in FIG. 7, after the ratchet arm 150 drops off of the passive surface 164 of a tooth and engages the active surface 165, the pallet 88 is free to begin moving in the rearward direction of arrow 142. As the pallet 88 is moved in the forward direction 142, under the influence of spring 156, the activation arm rotates around pivot 155 in the direction of arrow 168. Since the ratchet arm 150 is now engaged with the active surface 165 of a tooth, the ratchet wheel 160, as well as the auger 130, rotate in the direction of arrow 138 to scoop more residue 96' from the storage bucket 100, and deposit previously scraped residue 96" inside the permanent storage chamber 128 (see FIG. 3).

Figure 8:
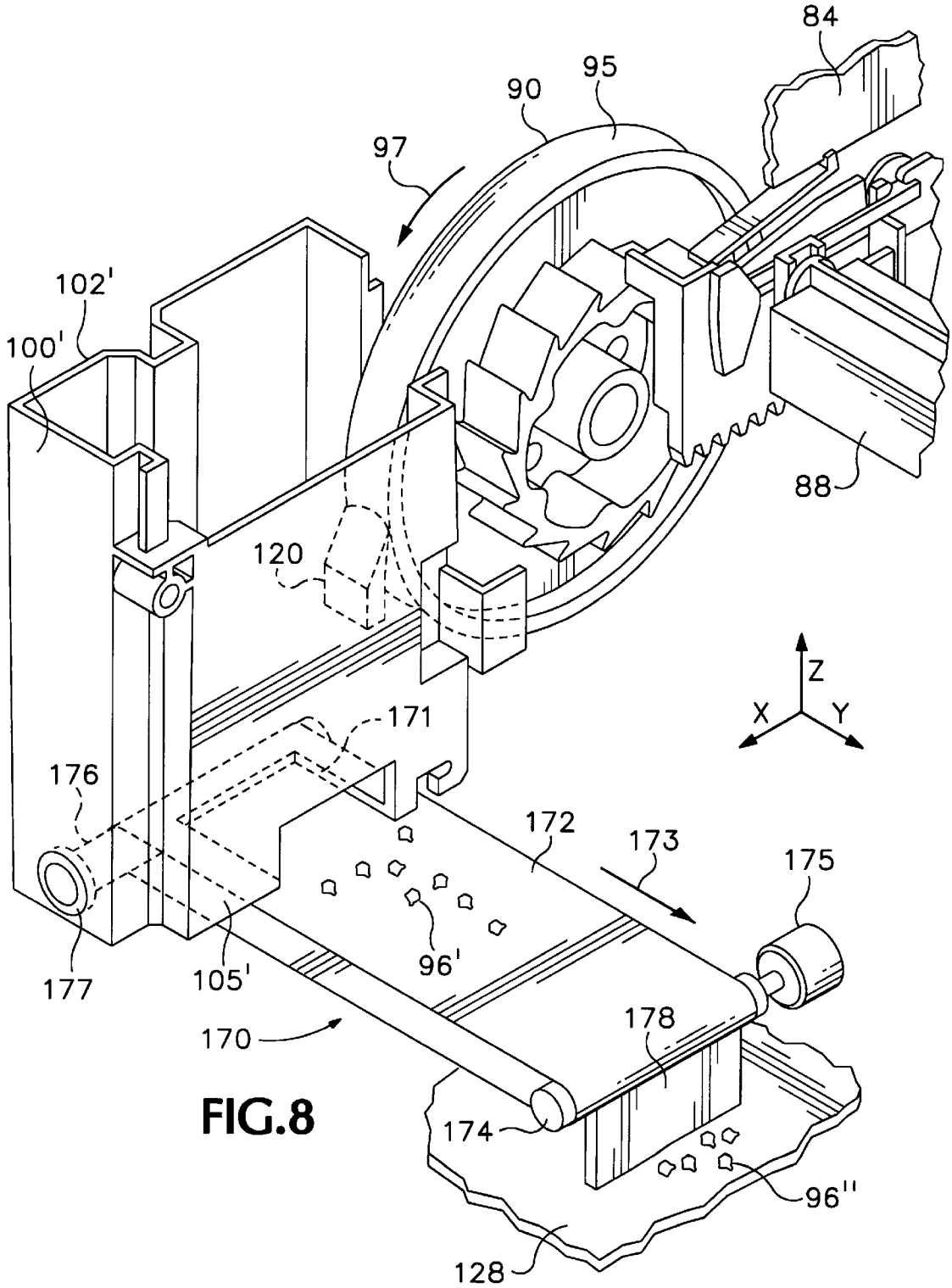
FIG. 8 is a perspective view of the service station of FIG. 1 including one form of a first embodiment of a transferring spittoon system having a conveyor belt transfer mechanism for moving ink residue from the temporary storage container to a permanent storage location.

FIG. 8 illustrates a second embodiment of the transferring spittoon system, here illustrated as a conveyor mechanism 170, constructed in accordance with the present invention. Here, different from the temporary storage bucket 100 in FIGS. 2–4, a storage bucket 100' has a body 102' which defines a bottomless opening 171 therethrough, leaving a chamber 105' defined by body 102' and cover 104. The ink residue 96' removed from the spit wheel 90 by scraper 120 lands upon an endless conveyor belt 172 running under the bucket opening 171. The conveyor belt 172 is driven in the direction of arrow 173 by a drive roller 174, which may be pivotally supported by the service station walls by conventional bearings or bushings (not shown). The drive roller 174 is coupled to a drive motor 175 which operates in response to signals received form the controller 40. The belt 172 also loops around an idler roller 176, which may be pivotally mounted to the temporary storage bucket body 102' using bearings or bushings, such as bushing 177. Rather than relying on the mere force of gravity to remove the ink residue 96' from the surface of the endless belt 172, it is preferable to include a scraper member 178, which may be supported by the base of the permanent storage cavity 128. The scraper 178 removes the residue 96' from the belt 172 and it is deposited as 96" in cavity 128. As an alternate to the drive motor 175, it is apparent that a ratcheting, linkage, or other mechanism may be used in conjunction with the platform 88 to incrementally advance the conveyor belt 172 in the direction of arrow 173.

Figure 9:
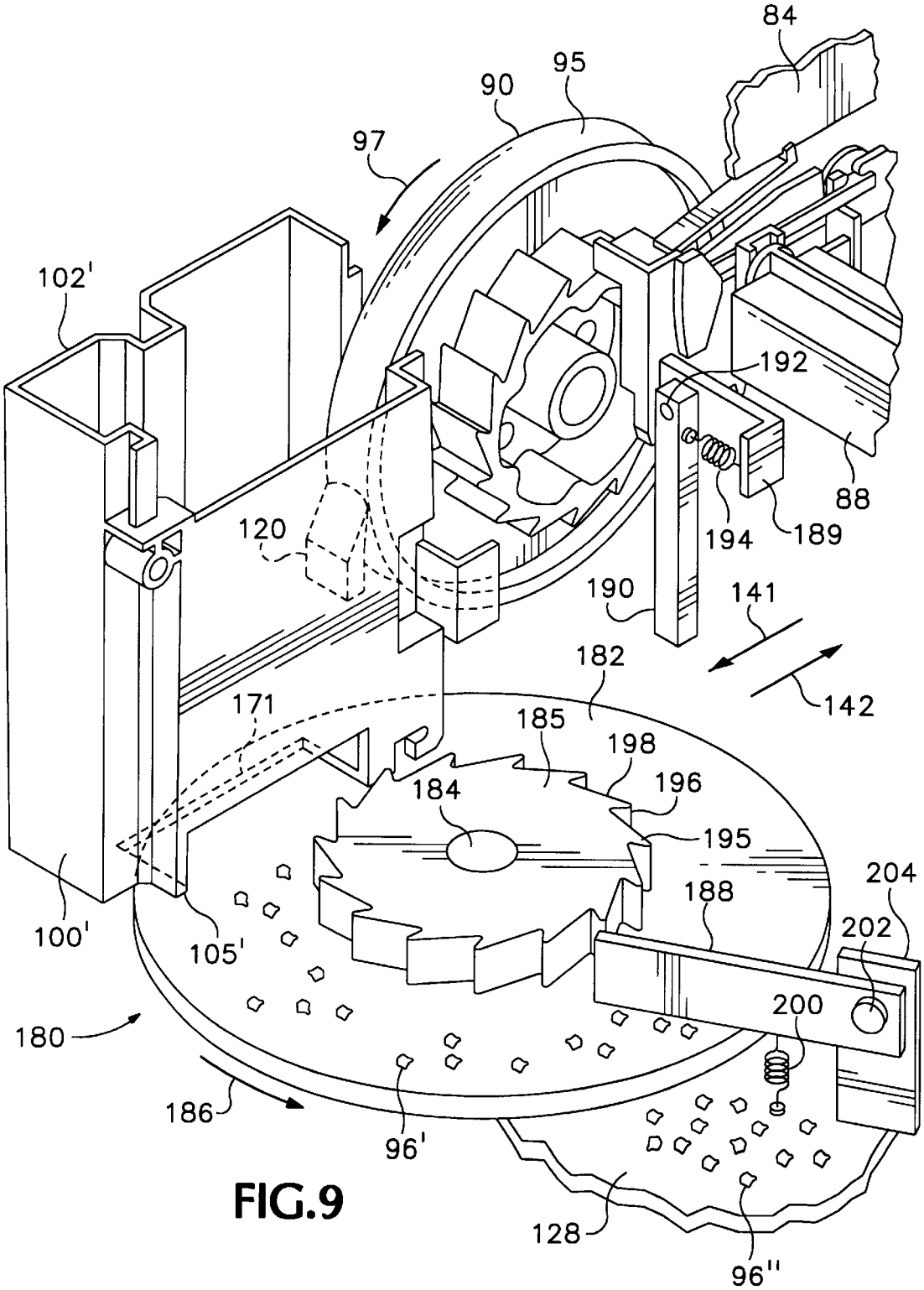
FIG. 9 is a perspective view of the service station of FIG. 1 including one form of a first embodiment of a transferring spittoon system having a turntable transfer mechanism for moving ink residue from the temporary storage container to a permanent storage location.

FIG. 9 illustrates a third embodiment of a transferring spittoon system, here shown as a turntable mechanism 180, constructed in accordance with the present invention to the permanent storage location 128. The turntable system 180 includes a turntable member 182 pivotally mounted at pivot shaft 184, which projects upwardly from the bottom surface of the storage cavity 128. The turntable 182 includes a ratchet wheel 185, which turns the turntable in the direction of arrow 186, as described further below with respect to FIGS. 10 and 11.

In the turntable transferring spittoon system 180, a temporary storage bucket 100' as described above with respect to FIG. 8 may be used. Here, the turntable 182 extends under opening 171 in the temporary bucket 100' to receive ink residue 96'. The ink residue 96' is transferred by turning of the turntable 182 in the direction of arrow 186. A slow indexing motion of the turntable 182 allows additional liquid volatiles to evaporate from the ink residue composition 96'. The ink residue 96' traverses around the surface of the turntable 182 until encountering a scraper member 188, which may extend upwardly from the bottom of the storage cavity 128. The scraper 188 serves to remove the ink residue 96' from the surface of the turntable 182, and deposit it as residue 96" inside the storage chamber 128. While the scraper 188 may be stationarily mounted to the bottom of the storage cavity 128, preferably, it is pivotally mounted as described further below with respect to FIGS. 10 and 11.

Figure 10:
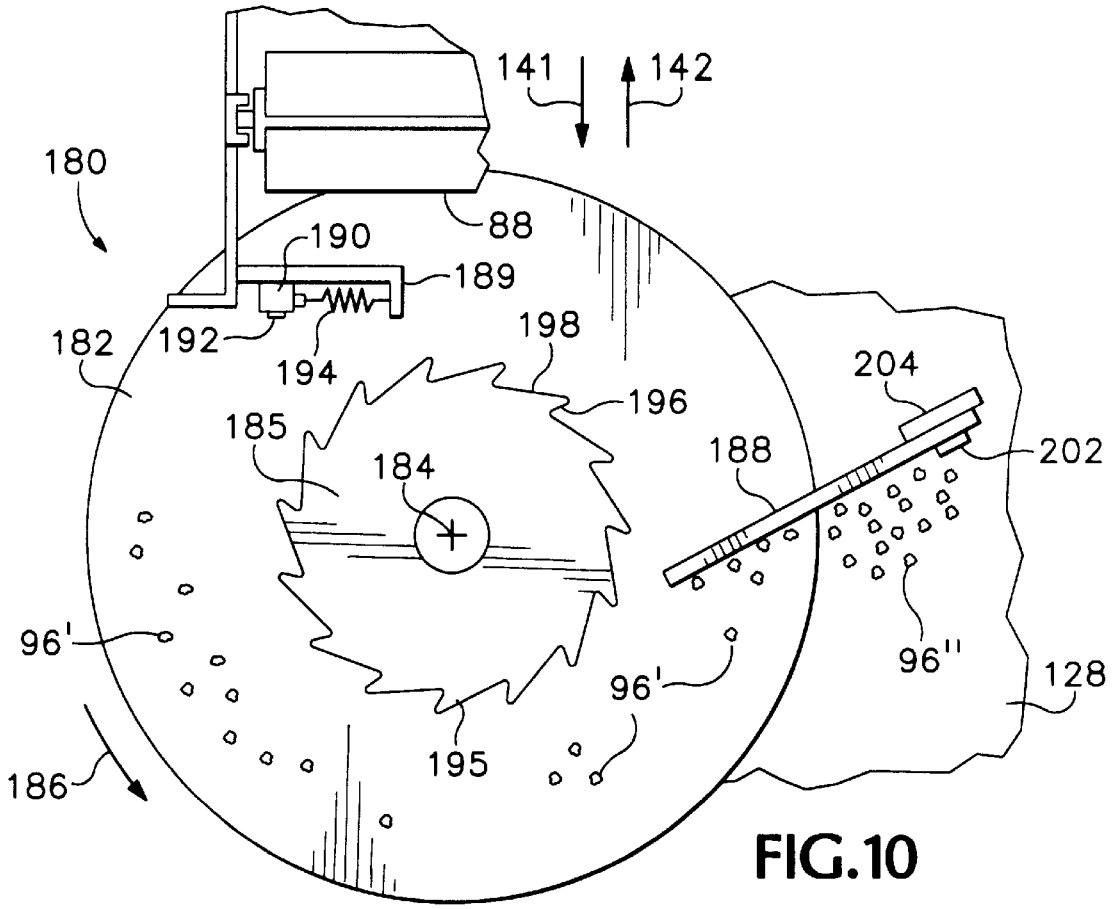
FIG. 10 is a schematic top plan view of one form of an indexing mechanism for rotating the turntable transfer mechanism of FIG. 9.
Figure 11:
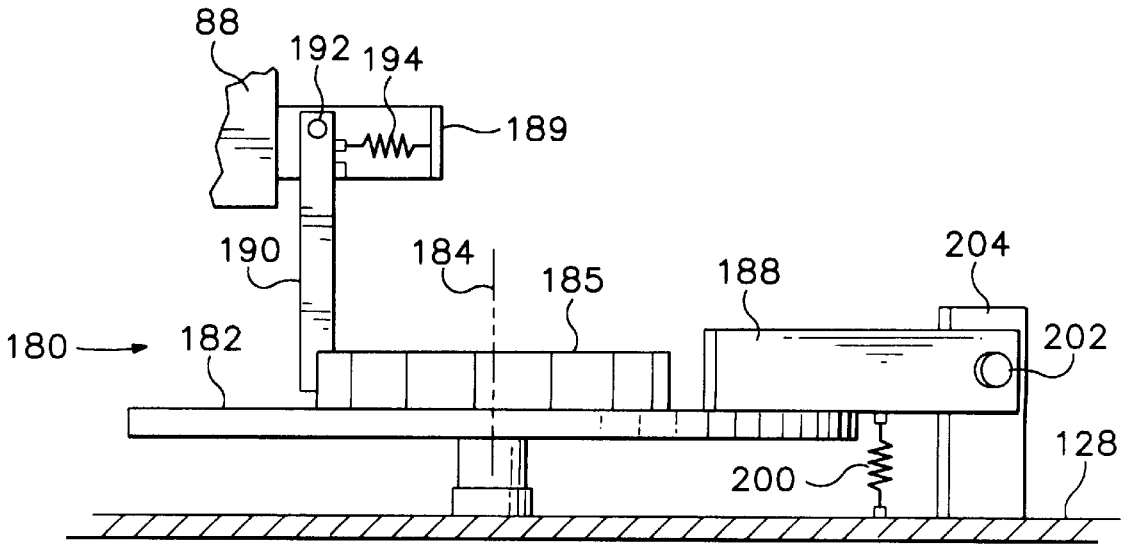
FIG. 11 is a schematic front elevational view of one form of an indexing mechanism for rotating the turntable transfer mechanism of FIG. 9.

Turning to FIGS. 10 and 11, the indexing operation of the spit wheel 182 is described. In FIG. 10, the pallet 88 includes a mounting bracket 189 which supports an activation arm or a pawl member 190. As the pallet 88 moves forward in the direction of arrow 141, the pawl 190 engages the ratchet wheel 185 to advance the turntable 182 in the direction of arrow 186. As better shown in FIG. 11, preferably the pawl 190 is pivotally mounted to the pallet 88 at a pivot post 192, and biased by a biasing member, such as spring 194, into positive contact with the ratchet wheel 185. To advance the turntable 182 in the direction of arrow 186, the ratchet wheel 185 includes a series of ratchet teeth 195, having an active surface 196 and a passive surface 198. As the pallet 88 moves in the forward direction 141, the pawl 190 is pulled into positive engagement with the active surface 196 of an engaged tooth 195, to drive the turntable 182 in the direction of arrow 186. When the pallet 88 retreats in the direction of arrow 142, the pawl 190 slides over the passive surface 198 of the next tooth in the clockwise direction of FIG. 10, and then is pulled into engagement with the active surface of this next tooth by the biasing action of return spring 194.

Returning to the scraping action of scraper 188, the preferred mounting scheme is also shown in FIGS. 10 and 11. Preferably, the scraper 188 is biased by a spring 200 toward the collection surface of turntable 182, with the scraper 188 being pivoted at post 202 to a support member 204 which extends upwardly from the base of the storage cavity 128. While the spring biased scraper 188 is believed to provide a more active scraping action against the transfer wheel 182, in some implementations it may be preferable to stationarily mount the scraper 188 to the base of cavity 128, or other locations on the service station frame 82.

Conclusion

A variety of advantages are realized using the transferring ink storage and spittoon system 80, whether used with the auger transferring mechanism 125, the conveyor belt mechanism 170, or the turntable mechanism 180. The primary advantage of these transferring mechanisms is the increased waste ink storage capacity for handling the pigment-based residue of the black pen 50. In contrast, the residue from the dye-based color inks has volatile components which readily dry when initially absorbed by an absorbent pad, leaving little solid residue in the pad. While a dye-based ink may be used in the black pen 50, the pigment-based black ink bonds on the surface of a printed sheet, yielding a crisp, sharp image with very little, if any bleeding of the edges, which has been known to occur when using dye-based black inks. Thus, while servicing the pigment-based black inks and handling the waste ink residue may be considered a nuisance at best, the resulting drastic improvement in the image quality has been deemed well worth the effort. Now use of the transferring ink storage systems 125, 170, 180 allows the expansion of pigment-based black inks to high volume printing environments, such as networked printers and short run press printers, because the ink residue storage volume has been greatly increased. Indeed, the transferring ink storage systems 125, 170, 180 have approximately eight times the storage volume of the Hewlett-Packard Company's DeskJet® 2000C Professional Series color inkjet printer which was described in the Background section above. This greater permanent storage capacity for the ink residue provides a volumetric efficiency that increases the lifespan of the printer 20, while providing consumers with an economical, robust printing unit.

We claim:

1. A spittoon system for receiving ink residue spit from an inkjet printhead in an inkjet printing mechanism, comprising:

a temporary storage container that receives ink residue which has been spit from the inkjet printhead, with the temporary storage container defining an exit opening therethrough;

a permanent storage container; and a transfer mechanism which receives the ink residue from the temporary storage container exit opening and transfers the ink residue to the permanent storage container.

2. A spittoon system according to claim 1 wherein the transfer mechanism includes:

an auger having an outer surface which receives the ink residue from the temporary storage container exit opening; and a rotating device which selectively rotates the auger to transfer the ink residue from the temporary storage container exit opening to the permanent storage container.

3. A spittoon system according to claim 1 wherein the transfer mechanism includes:

an endless belt having an outer surface which receives the ink residue from the temporary storage container exit opening; and a drive member which selectively drives an upper surface of the belt from the temporary storage container exit opening toward the permanent storage container.

4. A spittoon system according to claim 3 further including a scraper positioned to scrape the ink residue from the belt outer surface and direct the scraped residue into the permanent storage container.

5. A spittoon system according to claim 1 wherein the transfer mechanism includes:

a turntable having an upper surface which receives the ink residue from the temporary storage container exit opening; and a drive member which selectively rotates the turntable to transfer ink residue from the temporary storage container exit opening to the permanent storage container.

6. A spittoon system according to claim 5 further including a scraper positioned to scrape the ink residue from the turntable upper surface and direct the scraped residue into the permanent storage container.

7. A spittoon system according to claim 1 further including:

a rotatable spit wheel having a rim located to receive ink residue spit from the inkjet printhead;

a rotating device that selectively rotates the spit wheel; and a wheel scraper which presses against the rim of the spit wheel to scrape ink residue therefrom when the spit wheel is rotated by the rotating device, and which deposits the scraped ink residue in the temporary storage container.

8. A spittoon system according to claim 7 wherein:

the rotating device is activated by a selectively moveable pallet; and the transfer mechanism has an ink transfer member which receives the ink residue from the temporary storage container exit opening, and an activation member which is selectively engaged by the pallet to move the transfer member to transport the ink residue to the permanent storage container.

9. A spittoon system according to claim 8 further including a transfer scraper positioned to scrape the ink residue from the transfer member and direct the scraped residue into the permanent storage container.

10. A method of purging ink residue from an inkjet printhead in an inkjet printing mechanism, comprising the steps of:

providing a temporary storage container, a permanent storage container and a transfer mechanism;

collecting ink residue spit from the printhead in the temporary storage container;

transferring the collected ink residue from temporary storage container to the permanent storage container using the transfer mechanism; and storing transferred ink residue in the permanent storage container.

11. A method according to claim 10 wherein:

the providing step comprises providing the transfer mechanism as an auger; and the transferring step comprises rotating the auger to transport the ink residue to the permanent storage container.

12. A method according to claim 10 wherein:

the providing step comprises providing the transfer mechanism as an endless belt; and the transferring step comprises driving the belt to transport the ink residue to the permanent storage container.

13. A method according to claim 10 wherein:

the providing step comprises providing the transfer mechanism as a turntable; and the transferring step comprises rotating the turntable to transport the ink residue to the permanent storage container.

14. A method according to claim 10 wherein:

the providing step comprises providing a transfer scraper, and providing the transfer mechanism with a transport surface; and the method further includes the steps of scraping the ink residue from the transport surface, and directing the scraped ink residue into the permanent storage container.

15. A method according to claim 10 wherein:

the providing step further comprises providing a scraper and a rotatable spit wheel having a rim;

the method further includes the steps of:

spitting ink residue from the printhead onto the spit wheel rim;

rotating the spit wheel;

scraping ink residue from the spit wheel rim during the rotating step; and directing the ink residue into the temporary storage container after the scraping step.

16. An inkjet printing mechanism, comprising:

an inkjet printhead;

a carriage that carries the printhead through a printzone for printing and to a servicing region for printhead servicing; and a spittoon system located in the servicing region to receive ink residue spit from the printhead, with the spittoon system comprising:

a temporary storage container that receives ink residue which has been spit from the inkjet printhead, with the temporary storage container defining an exit opening therethrough;

a permanent storage container; and a transfer mechanism which receives the ink residue from the temporary storage container exit opening and transfers the ink residue to the permanent storage container.

17. An inkjet printing mechanism according to claim 16 wherein the transfer mechanism includes:

an auger having an outer surface which receives the ink residue from the temporary storage container exit opening; and a rotating device which selectively rotates the auger to transfer the ink residue from the temporary storage container exit opening to the permanent storage container.

18. An inkjet printing mechanism according to claim 16 wherein the transfer mechanism includes:

an endless belt having an outer surface which receives the ink residue from the temporary storage container exit opening; and a drive member which selectively drives an upper surface of the belt from the temporary storage container exit opening toward the permanent storage container.

19. An inkjet printing mechanism according to claim 16 wherein the transfer mechanism includes:

a turntable having an upper surface which receives the ink residue from the temporary storage container exit opening; and a drive member which selectively rotates the turntable to transfer ink residue from the temporary storage container exit opening to the permanent storage container.

20. An inkjet printing mechanism according to claim 16 wherein the spittoon system further includes:

a rotatable spit wheel having a rim located to receive ink residue spit from the inkjet printhead;

a rotating device that selectively rotates the spit wheel; and a wheel scraper which presses against the rim of the spit wheel to scrape ink residue therefrom when the spit wheel is rotated by the rotating device, and which deposits the scraped ink residue in the temporary storage container.

* * * * *